US012220039B2

(12) United States Patent
Suzuki

(10) Patent No.: US 12,220,039 B2
(45) Date of Patent: Feb. 11, 2025

(54) DISPENSING CONTAINER

(71) Applicant: YOSHINO KOGYOSHO CO., LTD., Tokyo (JP)

(72) Inventor: Akinori Suzuki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 18/564,712

(22) PCT Filed: Apr. 7, 2022

(86) PCT No.: PCT/JP2022/017250
§ 371 (c)(1),
(2) Date: Nov. 28, 2023

(87) PCT Pub. No.: WO2022/254966
PCT Pub. Date: Dec. 8, 2022

(65) Prior Publication Data

US 2024/0251929 A1 Aug. 1, 2024

(30) Foreign Application Priority Data

May 31, 2021 (JP) ..... 2021-091035

(51) Int. Cl.
*A45D 40/04* (2006.01)
*A45D 40/06* (2006.01)

(52) U.S. Cl.
CPC ..... *A45D 40/04* (2013.01); *A45D 40/06* (2013.01)

(58) Field of Classification Search
CPC ..... A45D 40/04; A45D 40/00; A45D 40/02; A45D 40/06; A45D 2040/208; A45D 40/205
(Continued)

(56) References Cited

U.S. PATENT DOCUMENTS 3,789,857 A * 2/1974 Ikeda ..... A45D 40/04 401/172
2016/0073765 A1* 3/2016 Thompson ..... A45D 40/205 401/55

FOREIGN PATENT DOCUMENTS

JP S54-007943 U 1/1979
JP H08-011948 A 1/1996
(Continued)

OTHER PUBLICATIONS

Jun. 21, 2022 International Search Report issued in International Patent Application No. PCT/JP2022/017250.

*Primary Examiner* — David J Walczak
(74) *Attorney, Agent, or Firm* — Oliff PLC

(57) ABSTRACT

A dispensing container includes: an operation portion including a dispensing member, the dispensing member extending in an up-down direction and being provided with a spiral groove; a sleeve surrounding the outside of the dispensing member and provided so as to be rotatable on a container axis; a middle plate body holding contents and provided inside the sleeve so as to be movable in the up-down direction in a state where rotation of the middle plate body on the container axis relative to the sleeve is restricted; and a movable tube extending downward from the middle plate body and including an engagement protrusion that engages with the spiral groove. A sliding portion, which is formed of softer material than either one member of the sleeve and the operation portion and on which the other member of the sleeve and the operation portion slides as the sleeve and the operation portion rotate relative to each other, is fixed to the one member.

4 Claims, 2 Drawing Sheets

(58) Field of Classification Search
USPC ..... 401/55, 68, 75, 172, 174
See application file for complete search history.

(56) References Cited

FOREIGN PATENT DOCUMENTS

| | | | |
|---|---|---|---|
| JP | 2021-036965 | A | 3/2021 |
| JP | 2021-054486 | A | 4/2021 |

* cited by examiner

DISPENSING CONTAINER

TECHNICAL FIELD

The present disclosure relates to a dispensing container.

Priority is claimed on Japanese Patent Application No. 2021-091035, filed May 31, 2021, the content of which is incorporated herein by reference.

BACKGROUND ART

A dispensing container includes an operation portion having a shape of a cylinder with a bottom, a sleeve supported rotatably on a container axis inside the operation portion, and a middle plate provided inside the sleeve and holding contents. In the dispensing container, when the operation portion and the sleeve are rotated relative to each other, the middle plate moves up and down inside the sleeve, so that the contents move forward and backward through the sleeve.

Incidentally, in the dispensing container, a configuration is adopted in which the marketability thereof is improved by applying a desired frictional resistance between the sleeve and the operation portion. As such a configuration, for example, Patent Document 1 below discloses a configuration in which an O-ring is interposed between the sleeve and a base cylinder. According to this configuration, it is possible to limit rattling between the sleeve and the base cylinder and to give a user a desired operation feeling when rotating the sleeve.

DOCUMENT OF RELATED ART

Patent Document

[Patent Document 1] Japanese Unexamined Patent Application, First Publication No. H8-11948

SUMMARY OF INVENTION

Problems to Solved by Invention

However, in the above-described conventional technology, the O-ring has to be prepared separately from the sleeve and the base cylinder, so it is difficult to reduce the number of assembly parts.

In addition, in the assembly process of the dispensing container, in order to interpose the O-ring between the sleeve and the base cylinder, it is necessary to attach the sleeve to the base cylinder after attaching the O-ring to the base cylinder. Therefore, there is still room for improvement regarding the setting properties of the O-ring. That is, since this configuration is that the O-ring is merely attached to the base cylinder, the position of the O-ring in the up-down direction with respect to the sleeve (and the base cylinder) tends to vary during setting. In this case, variations in the frictional resistance may occur depending on the products of the dispensing container, and the manufacturing efficiency may deteriorate due to adjusting the variations. Moreover, even if the O-ring is set to a desired position, the O-ring may shift in the up-down direction as the dispensing container is operated.

The present disclosure provides a dispensing container having high marketability while the number of assembly parts is reduced and the setting properties are improved.

Means for Solving Problems

In order to solve the above problems, the present disclosure adopts the following aspects.

A dispensing container of one aspect of the present disclosure includes: an operation portion including a transmission shaft, the transmission shaft extending in an up-down direction and being provided with a spiral groove; a sleeve surrounding an outside of the transmission shaft and provided so as to be rotatable on an axis line of the transmission shaft; a middle plate body holding contents and provided inside the sleeve so as to be movable in the up-down direction in a state where rotation of the middle plate body on the axis line relative to the sleeve is restricted; and a movable shaft extending downward from the middle plate body and including an engagement protrusion that engages with the spiral groove, and a sliding portion, which is formed of a softer material than either one member of the sleeve and the operation portion and on which the other member of the sleeve and the operation portion slides as the sleeve and the operation portion rotate relative to each other, is fixed to the one member.

According to the aspect, since the sliding portion is interposed between the sleeve and the operation portion, an appropriate frictional resistance can be applied between the sleeve and the operation portion by the sliding portion. Thereby, it is possible to limit rattling between the sleeve and the operation portion and to give a user an appropriate operation feeling when the operation portion and the sleeve are rotated relative to each other.

Particularly, in the aspect, a configuration is adopted in which the sliding portion is integrally fixed to the one member.

According to this configuration, it is possible to reduce the number of assembly parts in the assembly process of the dispensing container compared to a case where an O-ring or the like is attached to either the sleeve or the operation portion before the sleeve and the operation portion are set.

Furthermore, since the sliding portion is integrally fixed to the one member, at the time the sleeve and the operation portion are set or the dispensing container is operated, it is possible to limit the position of the sliding portion from varying with respect to the sleeve or the operation portion. Thereby, it is possible to limit variations in the frictional resistance depending on the products of the dispensing container. Further, the work required for adjusting the variations can be reduced, so the manufacturing efficiency can be improved.

As a result, it is possible to provide the dispensing container having high marketability while the number of assembly parts is reduced and the setting properties are improved.

In the dispensing container of the above aspect, the operation portion may be provided with a circumferential groove, the circumferential groove opening outward in a radial direction and extending on an entire circumference around the axis line, the sleeve may be provided with a protrusion, the protrusion protruding inward in the radial direction and being accommodated in the circumferential groove, the sliding portion may be integrally fixed to an inner surface of the circumferential groove, and the protrusion may move inside the circumferential groove while sliding on the sliding portion as the sleeve rotates on the axis line.

In this case, it is possible to apply an appropriate frictional resistance between the sliding portion and the protrusion and to limit, by the engagement between the protrusion and the circumferential groove, the positions of the sleeve and the operation portion from varying in the up-down direction. Thereby, the size of the dispensing container in the up-down direction can be reduced compared to, for example, a case where an engagement location in the up-down direction is provided at a different position from the sliding location with the O-ring.

In the dispensing container of the above aspect, the protrusion may be provided to include protrusions at intervals around the axis line, and the sliding portion may extend on an entire circumference around the axis line.

In this case, the sliding portion and the sleeve are always in contact with each other regardless of the position of the sleeve in the circumferential direction. Thereby, the sleeve is stably held on the operation portion. Further, it is possible to limit the frictional resistance acting between the sliding portion and the protrusion from becoming excessive compared to a configuration in which each of the sliding portion and the protrusion extends on the entire circumference. Therefore, it is easy to adjust the frictional resistance acting between the sleeve and the operation portion to be within an appropriate range.

In the dispensing container of the above aspect, the operation portion may include an exterior body having a shape of a cylinder with a bottom, and a fixed shaft member including the transmission shaft attached to a bottom wall of the exterior body, and the sliding portion may be integrally fixed to the fixed shaft member.

In this case, after the sleeve and the fixed shaft member are assembled, the sleeve and the operation portion together can be attached to the exterior body. Thereby, the positional alignment between the protrusion and the sliding portion can be performed in advance, so it is possible to limit variations in the frictional resistance depending on the products of the dispensing container.

Effects of Invention

According to the present disclosure, it is possible to provide a dispensing container having high marketability while the number of assembly parts is reduced and the setting properties are improved.

EMBODIMENTS OF INVENTION

Embodiments of the present disclosure are described below with reference to the drawings.

Figure 1:
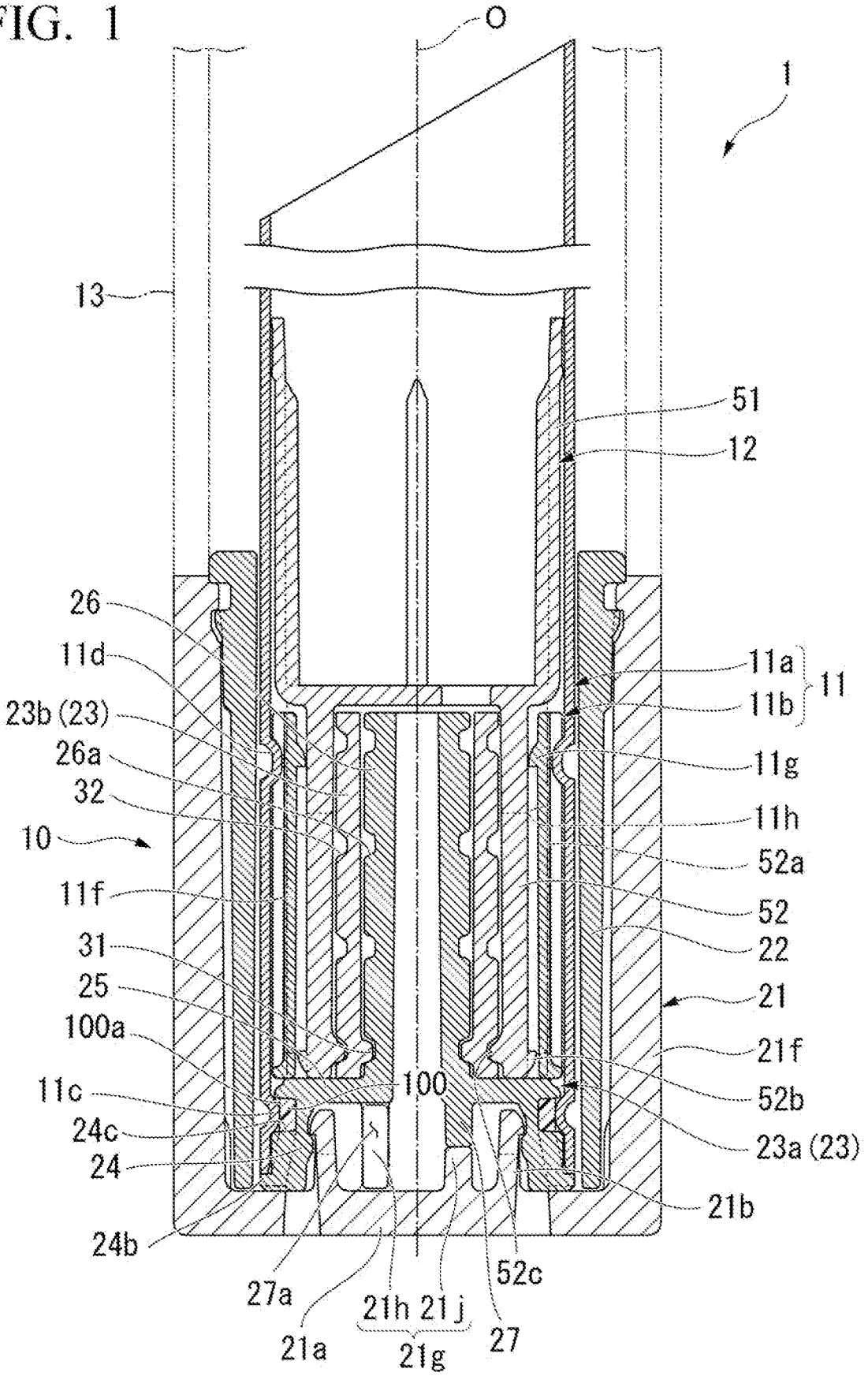
FIG. 1 is a cross-sectional view of a dispensing container of the present embodiment.

A dispensing container 1 shown in FIG. 1 is used by dispensing bar-shaped contents (not shown). Examples of the bar-shaped contents include cosmetics (lipstick, lip balm, stick eyeshadow and the like), medicines, glue and the like.

The dispensing container 1 includes an operation portion (i.e., one member) 10, a sleeve (i.e., the other member) 11, a middle plate 12 and a cap 13. The operation portion 10, the sleeve 11 and the middle plate 12 are disposed such that their central axis lines are positioned in a common axis. Each component of the dispensing container 1 is a molded product made of synthetic resin unless otherwise specified.

Hereinafter, the common axis is referred to as a container axis (i.e., axis line) O, and a direction along the container axis O is referred to as an up-down direction. In a plan view viewed in the up-down direction, a direction crossing the container axis O is referred to as a radial direction, and a direction going around the container axis O is referred to as a circumferential direction. In this case, in the dispensing container 1, the top wall-side of the cap 13 in the up-down direction is referred to as an upper side, and the bottom wall-side (i.e., a bottom wall 21*a* of an exterior body 21) of the operation portion 10 is referred to as a lower side. In the circumferential directions, a direction for lifting the contents is referred to as a dispensing direction, and a direction for lowering the contents is referred to as a retracting direction.

The operation portion 10 constitutes the exterior of a lower portion of the dispensing container 1. The operation portion 10 as a whole is formed in a shape of a cylinder with a bottom disposed coaxially with the container axis O. The operation portion 10 includes the exterior body 21, an inner member 22 and a dispensing member 23.

The exterior body 21 is integrally formed in a shape of a cylinder with a bottom. The bottom wall 21*a* of the exterior body 21 is provided with an attachment tube 21*b* that extends upward. The attachment tube 21*b* is disposed coaxially with the container axis O. In the exterior body 21, the bottom wall 21*a* and a peripheral wall 21*f* may be separate bodies.

A portion of the bottom wall 21*a* positioned further inward in the radial direction than the attachment tube 21*b* is provided with a first positioning portion 21*g*. The first positioning portion 21*g* includes a protrusion 21*h* and a slope portion 21*j*.

The protrusion 21*h* protrudes upward from the bottom wall 21*a*.

The slope portion 21*j* extends spirally around the container axis O such that the protruding height thereof from the bottom wall 21*a* gradually increases from one side to the other side in the circumferential direction.

The inner member 22 is formed in a cylindrical shape disposed coaxially with the exterior body 21. The inner member 22 is fitted inside the exterior body 21 from above. The inner member 22 is provided so as to be non-rotatable in the circumferential direction relative to the exterior body 21 in a state where the upper end portion of the inner member 22 protrudes upward from the exterior body 21. The inner member 22 may be formed integrally with the exterior body 21. In the operation portion 10, as long as the inner peripheral surface of the inner member 22 is formed in a circular shape in a plan view, the shape of the peripheral wall 21*f* in a plan view may have a shape other than circular.

The dispensing member 23 supports the middle plate 12 inside the exterior body 21 such that the middle plate 12 is movable up and down. The dispensing member 23 includes a fixed shaft member 23*a* and an outer transmission shaft 23*b*.

The fixed shaft member 23*a* is provided so as to be non-rotatable in the circumferential direction relative to the exterior body 21. Specifically, the fixed shaft member 23*a* includes a fitting tube 24, a pedestal portion 25, an inner transmission shaft (i.e., a transmission shaft) 26 and a second positioning portion 27.

The fitting tube 24 is disposed coaxially with the container axis O. The attachment tube 21*b* is undercut-fitted inside the fitting tube 24. That is, a protrusion of the attachment tube 21*b* that protrudes outward in the radial direction engages with a portion of the fitting tube 24, thereby preventing the attachment tube 21*b* from separating from the fitting tube 24.

The lower end portion of the fitting tube 24 is provided with a projecting portion 24*b* that projects outward in the radial direction. The upper portion of the fitting tube 24 is provided with a circumferential groove 24*c*. The circumferential groove 24*c* opens on the outer peripheral surface of the fitting tube 24 and extends on the entire circumference in the circumferential direction on the outer peripheral surface of the fitting tube 24.

The pedestal portion 25 projects inward in the radial direction from the upper opening edge of the fitting tube 24. The pedestal portion 25 is formed in an annular shape disposed coaxially with the container axis O. The upper edge of the attachment tube 21*b* is close to or in contact with the inner peripheral portion of the pedestal portion 25 from below.

The inner transmission shaft (i.e., the transmission shaft) 26 extends upward from the inner peripheral edge of the pedestal portion 25. The inner transmission shaft 26 is formed in a cylindrical shape disposed coaxially with the container axis O. The outer peripheral surface of the inner transmission shaft 26 is provided with an inner spiral groove (i.e., a spiral groove) 26*a*. The inner spiral groove 26*a* spirally extends upward as going in the dispensing direction. In the present embodiment, the inner spiral groove 26*a* is formed of two grooves. However, the inner spiral groove 26*a* may be formed of one groove or three or more grooves.

The second positioning portion 27 is formed in a cylindrical shape disposed coaxially with the container axis O. A portion of the second positioning portion 27 in the circumferential direction is provided with a recess 27*a* that divides the second positioning portion 27 in the circumferential direction. The second positioning portion 27 has a protruding height from the pedestal portion 25 that gradually decreases from one side toward the other side in the circumferential direction. In a state where the fitting tube 24 is fitted into the attachment tube 21*b*, the slope portion 21*j* and the second positioning portion 27 are close to or in contact with each other in the up-down direction, and the protrusion 21*h* is accommodated in the recess 27*a*. Thereby, the fixed shaft member 23*a* and the exterior body 21 are assembled in a state where the fixed shaft member 23*a* and the exterior body 21 are positioned in the up-down direction and the circumferential direction.

The outer transmission shaft 23*b* surrounds the circumference of the inner transmission shaft 26 on the outside of the inner transmission shaft 26. The lower end portion of the outer transmission shaft 23*b* is provided with a first engagement protrusion 31 that protrudes inward in the radial direction. The first engagement protrusion 31 is accommodated (engaged) in the inner spiral groove 26*a* of the inner transmission shaft 26. As the outer transmission shaft 23*b* rotates in the circumferential direction relative to the inner transmission shaft 26, the first engagement protrusion 31 spirally moves inside the inner spiral groove 26*a*, so that the outer transmission shaft 23*b* moves up and down relative to the inner transmission shaft 26. In the present embodiment, depending on the number of grooves of the inner spiral groove 26*a*, two first engagement protrusions 31 are provided at intervals in the circumferential direction. Each first engagement protrusion 31 obliquely extends along the inner spiral groove 26*a*.

The outer peripheral surface of the outer transmission shaft 23*b* is provided with an outer spiral groove 32. The outer spiral groove 32 spirally extends upward as going in the dispensing direction. In the present embodiment, the outer spiral groove 32 is formed of two grooves. However, the outer spiral groove 32 may be formed of one groove or three or more grooves.

The sleeve 11 is provided inside the operation portion 10 so as to be rotatable in the circumferential direction relative to the operation portion 10. The sleeve 11 is formed in a double cylindrical shape disposed coaxially with the container axis O. Specifically, the sleeve 11 includes an outer sleeve 11*a* and an inner sleeve 11*b*.

The outer sleeve 11*a* is inserted into the operation portion 10 through a gap between the inner member 22 and the pedestal portion 25 inside the inner member 22. Therefore, the outer sleeve 11*a* surrounds the circumference of the inner transmission shaft 26. The lower edge of the outer sleeve 11*a* is supported by the projecting portion 24*b* from below. The upper edge of the outer sleeve 11*a* is inclined with respect to the container axis O above the operation portion 10. The outer sleeve 11*a* may be formed of a metal material or the like.

The outer sleeve 11*a* is provided with a lower protrusion (i.e., a protrusion) 11*c* and an upper protrusion 11*d*.

The lower protrusion 11*c* protrudes inward in the radial direction in the lower end portion of the outer sleeve 11*a*. The lower protrusion 11*c* engages with the upper opening edge and the lower opening edge of the circumferential groove 24*c* in a state where the lower protrusion 11*c* is accommodated in the circumferential groove 24*c*. Thereby, the outer sleeve 11*a* is supported by the fixed shaft member 23*a* so as to be rotatable in the circumferential direction in a state where the movement of the outer sleeve 11*a* in the up-down direction relative to the operation portion 10 is restricted.

The upper protrusion 11*d* protrudes inward in the radial direction from an intermediate portion (i.e., a portion positioned below the upper edge of the inner member 22 and above the lower protrusion 11*c*) of the outer sleeve 11*a*.

The inner sleeve 11*b* is provided so as to be movable up and down relative to the outer sleeve 11*a* in a state where the rotation of the inner sleeve 11*b* in the circumferential direction relative to the outer sleeve 11*a* is restricted. The length of the inner sleeve 11*b* in the up-down direction is less than the length of the outer sleeve 11*a* in the up-down direction. When the inner sleeve 11*b* is at its lowest position, the inner sleeve 11*b* is close to or in contact with the outer peripheral portion of the pedestal portion 25 from above.

The inner sleeve 11*b* is provided with a first restricting groove 11*f* that opens on the outer peripheral surface of the inner sleeve 11*b*. The first restricting groove 11*f* extends in the up-down direction at a position of the inner sleeve 11*b* that faces the upper protrusion 11*d* in the radial direction. The upper protrusion 11*d* is accommodated in the first restricting groove 11*f*. The inner sleeve 11*b* guides the upper protrusion 11*d* to move in the up-down direction while limiting the upper protrusion 11*d* from moving in the circumferential direction inside the first restricting groove 11*f*. In the present embodiment, the first restricting groove 11*f* is open at the upper edge of the inner sleeve 11*b* but is not open at the lower edge of the inner sleeve 11*b*. Therefore, when the inner sleeve 11*b* lifts, the upper protrusion 11*d* contacts the bottom surface of the first restricting groove 11*f* from above, thereby preventing the upper protrusion 11*d* from detaching from the first restricting groove 11*f*.

The upper end portion of the inner sleeve 11*b* is provided with a stopper protrusion 11*g* that protrudes inward in the radial direction.

A position of the inner sleeve 11*b* different from the stopper protrusion 11*g* in the circumferential direction is provided with a second restricting groove 11*h* that opens on the inner peripheral surface of the inner sleeve 11*b*. The second restricting groove 11*h* extends in the up-down direction and is open on both of upper and lower edges of the inner sleeve 11*b*.

The middle plate 12 is provided inside the sleeve 11 so as to movable in the up-down direction relative to the sleeve 11 in a state where the rotation of the middle plate 12 in the circumferential direction relative to the sleeve 11 (i.e., the inner sleeve 11*b*) is restricted. The middle plate 12 includes a middle plate body 51 and a movable tube (i.e., a movable shaft) 52.

The middle plate body 51 is formed in a shape of a cylinder with a bottom coaxial with the container axis O. The middle plate body 51 is accommodated in a portion inside the outer sleeve 11*a* positioned above the inner transmission shaft 26. The middle plate body 51 is filled with the contents. The contents are filled in a state of protruding upward from the middle plate body 51.

The movable tube 52 is formed integrally with the middle plate body 51. The movable tube 52 extends downward from the bottom wall of the middle plate body 51. The movable tube 52 is inserted inside the inner sleeve 11*b* and surrounds the circumference of the outer transmission shaft 23*b*. The movable tube 52 is provided a ridge portion 52*a* that protrudes outward in the radial direction. The ridge portion 52*a* extends in the up-down direction on the outer peripheral surface of the movable tube 52. The ridge portion 52*a* is accommodated in the second restricting groove 11*h*. When the ridge portion 52*a* contacts the inner surface of the second restricting groove 11*h* in the circumferential direction, the rotation of the middle plate 12 relative to the inner sleeve 11*b* is restricted in a state where the middle plate 12 is allowed to move up and down relative to the inner sleeve 11*b*.

A position of the lower end portion of the movable tube 52 different from the ridge portion 52*a* in the circumferential direction is provided with a stopper protrusion 52*b* that protrudes outward in the radial direction. The stopper protrusion 52*b* faces the stopper protrusion 11*g* of the inner sleeve 11*b* in the up-down direction. When the stopper protrusion 52*b* contacts the stopper protrusion 11*g* of the inner sleeve 11*b* from below, the movement of the middle plate 12 upward relative to the inner sleeve 11*b* is restricted.

The lower end portion of the movable tube 52 is provided with a second engagement protrusion (i.e., an engagement protrusion) 52*c* that protrudes inward in the radial direction. The second engagement protrusion 52*c* is accommodated (engaged) in the outer spiral groove 32. As the movable tube 52 rotates in the circumferential direction relative to the outer transmission shaft 23*b*, the second engagement protrusion 52*c* spirally moves inside the outer spiral groove 32, so that the movable tube 52 moves up and down relative to the outer transmission shaft 23*b*. In the present embodiment, depending on the number of grooves of the outer spiral groove 32, two second engagement protrusions 52*c* are provided at intervals in the circumferential direction. Each second engagement protrusion 52*c* obliquely extends along the outer spiral groove 32.

The cap 13 is formed in a shape of a cylinder with a top disposed coaxially with the container axis O. The middle plate 12 is detachably attached to the cap 13 in a state where the upper portion of the sleeve 11 (i.e., the outer sleeve 11*a*) is inserted through the cap 13.

A sliding portion 100 is integrally fixed to the above-described fixed shaft member 23*a*. The sliding portion 100 is formed of a soft material softer than the material (for example, PP or the like) of the fixed shaft member 23*a*, the soft material has a higher elastic modulus than that of the fixed shaft member 23*a* and a higher coefficient of friction than that of the fixed shaft member 23*a*. Examples of such a material include thermoplastic resins such as elastomer. The sliding portion 100 is integrally fixed to the fixed shaft member 23*a* by insert molding. The sliding portion 100 may be formed integrally with the fixed shaft member 23*a* by two-color molding together with the fixed shaft member 23*a*.

The sliding portion 100 is embedded in the circumferential groove 24*c*. In a longitudinal cross-sectional view in the up-down direction, the sliding portion 100 is fixed to the entire range of side surfaces facing each other in the up-down direction and a bottom surface positioned inward in the radial direction among inner surfaces of the circumferential groove 24*c*. An outer peripheral surface 100*a* among outer surfaces of the sliding portion 100, which faces outward in the radial direction, is positioned to be further inward in the radial direction than the outer peripheral surface of the fitting tube 24.

The above-described lower protrusion 11*c* is in contact with the outer peripheral surface 100*a* of the sliding portion 100 in the radial direction in a state where the lower protrusion 11*c* is accommodated in the circumferential groove 24*c*. When the outer sleeve 11*a* rotates on the axis line O relative to the operation portion 10 (i.e., the fixed shaft member 23*a*), the lower protrusion 11*c* moves inside the circumferential groove 24*c* while sliding on the outer peripheral surface 100*a* of the sliding portion 100. That is, the outer peripheral surface 100*a* of the sliding portion 100 functions as a sliding surface on which the top portion of the lower protrusion 11*c* slides when the outer sleeve 11*a* rotates relative to the fixed shaft member 23*a*. In the example shown in the drawings, the outer peripheral surface 100*a* of the sliding portion 100 is formed in a flat surface that linearly extends in the up-down direction. However, the outer peripheral surface 100*a* may be a curved surface or the like along, for example, the shape of the outer surface of the lower protrusion 11*c*.

The sliding portion 100 is provided on the entire circumference in the circumferential direction inside the circumferential groove 24*c*. The above-described lower protrusion 11*c* is provided in the outer sleeve 11*a* to include lower protrusions at intervals in the circumferential direction. However, a configuration may be adopted in which the sliding portion 100 is provided to include sliding portions at intervals in the circumferential direction and the lower protrusion 11*c* extends on the entire circumference in the circumferential direction. A configuration may be adopted in which the sliding portion 100 and the lower protrusion 11*c* are in contact with each other at a portion in the circumferential direction.

The above-described dispensing container 1 is manufactured by assembling an exterior module in which the exterior body 21 and the inner member 22 are assembled and a middle plate module in which the middle plate 12 and the dispensing member 23 are assembled. That is, in the assembly process of the dispensing container 1, when the middle plate module is inserted into the exterior module, the attachment tube 21*b* is fitted into the fitting tube 24, and the protrusion 21*h* of the first positioning portion 21*g* is engaged inside the recess 27*a* of the second positioning portion 27. Thereby, the above-described dispensing container 1 is manufactured.

Next, the operation of the above-described dispensing container 1 is described. In the following description, how to use the dispensing container 1 is described first, and then how to assemble the dispensing container 1 is described.

When the dispensing container 1 is used, the cap 13 is removed first from the operation portion 10. Next, each of the outer sleeve 11*a* and the exterior body 21 (i.e., the peripheral wall 21*f*) is gripped, and the operation portion 10 and the sleeve 11 are rotated relative to each other in the dispensing direction. At this time, each of the inner member 22 and the fixed shaft member 23*a* is attached to the exterior body 21 so as to be not-rotatable relative to the exterior body 21, so the exterior body 21, the inner member 22 and the fixed shaft member 23*a* rotate together. On the other hand, the outer sleeve 11*a* and the inner sleeve 11*b* are attached together so as to be not-rotatable relative to each other, and the inner sleeve 11*b* and the middle plate 12 are attached together so as to be not-rotatable relative to each other, so the sleeve 11 and the middle plate 12 rotate together.

When the operation portion 10 and the sleeve 11 are rotated relative to each other, at least one motion of two motions occurs, one of the two motions is that the inner transmission shaft 26 and the outer transmission shaft 23*b* rotate together relative to the movable tube 52, and the other of the two motions is that the inner transmission shaft 26 rotates relative to the outer transmission shaft 23*b*.

In a case where the inner transmission shaft 26 and the outer transmission shaft 23*b* rotate together relative to the movable tube 52, the second engagement protrusion 52*c* spirally moves inside the outer spiral groove 32 in a state of being engaged inside the outer spiral groove 32, so that the movable tube 52 (i.e., the middle plate 12) lifts relative to the dispensing member 23. In this way, the motion that the middle plate 12 lifts by the dispensing member 23 and the movable tube 52 rotating relative to each other in the dispensing direction is referred to as "first motion" in the present description.

In a case where the inner transmission shaft 26 rotates relative to the outer transmission shaft 23*b*, the first engagement protrusion 31 spirally moves inside the inner spiral groove 26*a* in a state of being engaged inside the inner spiral groove 26*a*, so that the outer transmission shaft 23*b* lifts relative to the inner transmission shaft 26. At this time, the second engagement protrusion 52*c* is pushed up through the inner surface of the outer spiral groove 32, so that the middle plate 12 lifts together with the outer transmission shaft 23*b*. In this way, the motion that the middle plate 12 lifts together with the outer transmission shaft 23*b* by the inner transmission shaft 26 and the outer transmission shaft 23*b* rotating relative to each other in the dispensing direction is referred to as "second motion" in the present description.

Figure 2:
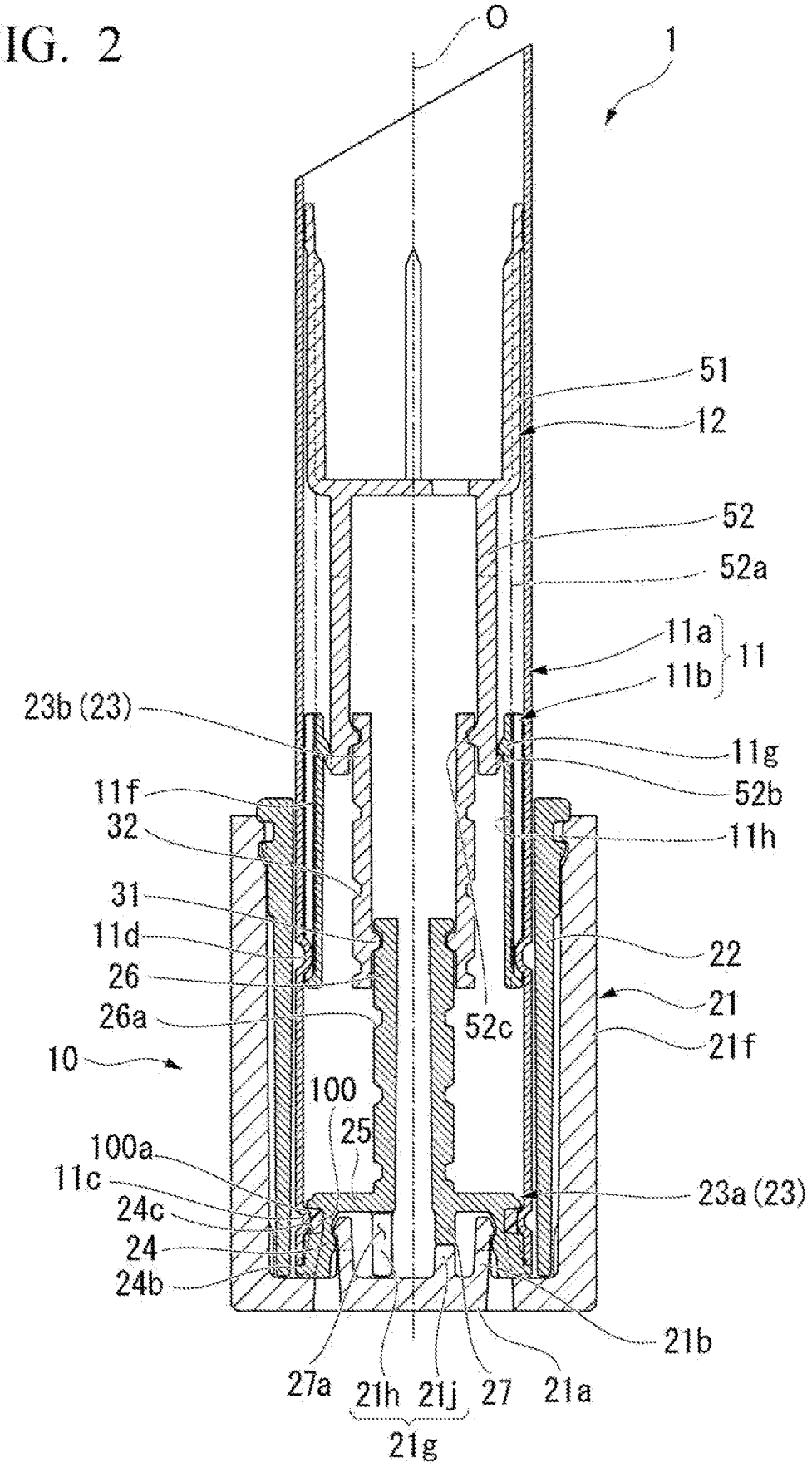
FIG. 2 is an operation-showing diagram when the dispensing container of the present embodiment is used.

That is, as shown in FIGS. 1 and 2, when the operation portion 10 and the sleeve 11 are rotated relative to each other in the dispensing direction, the middle plate 12 lifts by at least one motion of the first motion and the second motion. Thereby, the contents are dispensed upward from the sleeve 11. Which the first motion and the second motion occurs varies depending on the frictional resistance or the like between members. However, even if either one of the motions mainly occurs, the contents are dispensed, so the user can use the contents. Both of the first motion and the second motion may occur at the same time.

In the initial stage that the middle plate 12 lifts by the first motion or the second motion, the middle plate 12 lifts relative to the inner sleeve 11*b* (i.e., a first upward moving process). Specifically, in the first upward moving process, the ridge portion 52*a* is guided by the second restricting groove 11*h*, and thereby the middle plate 12 lifts relative to the inner sleeve 11*b* in a state where the rotation of the middle plate 12 relative to the inner sleeve 11*b* is restricted. In the first upward moving process, the stopper protrusion 52*b* of the middle plate 12 contacts the stopper protrusion 11*g* of the inner sleeve 11*b* from below. Thereby, the lifting of the middle plate 12 relative to the inner sleeve 11*b* is restricted.

When the middle plate 12 starts further lifting by the first motion or the second motion after the first upward moving process, the inner sleeve 11*b* is pushed up through the stopper protrusions 11*g* and 52*b*. Thereby, the middle plate 12 together with the inner sleeve 11*b* lifts relative the outer sleeve 11*a* (i.e., a second upward moving process). In the second upward moving process, since the upper protrusion 11*d* is accommodated in the restricting groove 11*f*, the inner sleeve 11*b* lifts relative to the outer sleeve 11*a* in a state where the rotation of the inner sleeve 11*b* relative to the outer sleeve 11*a* is restricted. In the second upward moving process, the bottom surface of the restricting groove 11*f* contacts the upper protrusion 11*d* from below, so that the lifting of the inner sleeve 11*b* relative to the outer sleeve 11*a* is restricted. Thereby, the middle plate 12 reaches its highest position. In the present embodiment, a process is described in which the second upward moving process occurs after the first upward moving process, but the first upward moving process may occur after the second upward moving process, or the first upward moving process and the second upward moving process may occur at the same time.

In order to lower the middle plate 12, the operation portion 10 and the sleeve 11 are rotated relative to each other in the retracting direction. Then, the middle plate 12 lowers relative to the sleeve 11 by a motion that the inner transmission shaft 26 and the outer transmission shaft 23*b* rotate together relative to the movable tube 52 or a motion that the inner transmission shaft 26 rotates relative to the outer transmission shaft 23*b*. As the middle plate 12 lowers, the inner sleeve 11*b* lowers due to its weight together with the middle plate 12. Then, when the lower edge of the inner sleeve 11*b* contacts the pedestal portion 25, the lowering of the inner sleeve 11*b* relative to the outer sleeve 11*a* is restricted. Thereafter, when the middle plate 12 further lowers, the middle plate 12 lowers relative to the outer sleeve 11*a* and the inner sleeve 11*b*.

In the present embodiment, a configuration is adopted in which the sliding portion 100 is fixed to the fixed shaft member 23*a* constituting the operation portion 10, slides on the sleeve 11*a* (i.e., the lower protrusion 11*c*) as the sleeve 11 and the operation portion 10 rotate relative to each other, and is formed of a softer material than that of the fixed shaft member 23*a*.

According to this configuration, since the sliding portion 100 is interposed between the sleeve 11 and the fixed shaft member 23*a*, an appropriate frictional resistance can be applied between the sleeve 11 and the fixed shaft member 23*a* by the sliding portion 100. Thereby, it is possible to limit rattling between the sleeve 11 and the fixed shaft member 23*a* and to give the user an appropriate operation feeling when the sleeve 11 and the fixed shaft member 23*a* are rotated relative to each other.

Particularly, in the present embodiment, a configuration is adopted in which the sliding portion 100 is integrally fixed to the fixed shaft member 23*a*.

According to this configuration, it is possible to reduce the number of assembly parts in the assembly process of the dispensing container 1 compared to a case where an O-ring or the like is attached to either the sleeve 11 or the fixed shaft member 23*a* before the sleeve 11 and the fixed shaft member 23*a* are set.

Furthermore, since the sliding portion 100 is integrally fixed to the fixed shaft member 23*a*, at the time the sleeve 11 and the fixed shaft member 23*a* are set or the dispensing container 1 is operated, it is possible to limit the position of the sliding portion 100 from varying with respect to the sleeve 11 or the fixed shaft member 23*a*. Thereby, it is possible to limit variations in the frictional resistance depending on the products of the dispensing container 1. Further, the work required for adjusting the variations can be reduced, so the manufacturing efficiency can be improved.

As a result, it is possible to provide the dispensing container 1 having high marketability while the number of assembly parts is reduced and the setting properties are improved.

In the present embodiment, a configuration is adopted in which the sliding portion 100 is integrally fixed to the inner surface of the circumferential groove 24*c*, and the outer sleeve 11*a* is provided with the lower protrusion 11*c* that is accommodated in the circumferential groove 24*c* and that moves inside the circumferential groove 24*c* as the outer sleeve 11*a* rotates.

According to this configuration, it is possible to apply an appropriate frictional resistance between the sliding portion 100 and the lower protrusion 11*c* and to limit, by the engagement between the lower protrusion 11*c* and the circumferential groove 24*c*, the positions of the sleeve 11*a* and the fixed shaft member 23*a* from varying in the up-down direction. Thereby, the size of the dispensing container 1 in the up-down direction can be reduced compared to, for example, a case where an engagement location in the up-down direction is provided at a different position from the sliding location with the O-ring.

In the present embodiment, a configuration is adopted in which the sliding portion 100 is provided on the entire circumference in the circumferential direction inside the circumferential groove 24*c*, and the lower protrusion 11*c* is provided to include lower protrusions at intervals in the circumferential direction.

According to this configuration, the sliding portion 100 and the outer sleeve 11*a* are always in contact with each other regardless of the position of the outer sleeve 11*a* in the circumferential direction. Thereby, the outer sleeve 11*a* is stably held on the fixed shaft member 23*a*. Further, it is possible to limit the frictional resistance acting between the sliding portion 100 and the lower protrusion 11*c* from becoming excessive compared to a configuration in which each of the sliding portion 100 and the lower protrusion 11*c* extends on the entire circumference. Thereby, it is easy to adjust the frictional resistance acting between the sleeve 11 and the fixed shaft member 23*a* to be within an appropriate range.

In the present embodiment, the operation portion 10 includes the exterior body 21 having a shape of a cylinder with a bottom, and the fixed shaft member 23*a* attached to the bottom wall 21*a* of the exterior body 21.

According to this configuration, after the outer sleeve 11*a* and the fixed shaft member 23*a* are assembled, the outer sleeve 11*a* and the fixed shaft member 23*a* together can be attached to the exterior body 21. Thereby, the positional alignment between the lower protrusion 11*c* and the sliding portion 10 can be performed in advance, so it is possible to limit variations in the frictional resistance depending on the products of the dispensing container 1.

Although appropriate embodiments of the present disclosure are described above, the present disclosure is not limited to the embodiments. Additions, omissions, replacements or other modifications to components can be adopted within the scope of the present disclosure. The present disclosure is not limited by the above description but is limited only by the appended claims.

In the above-described embodiments, a configuration is described in which the exterior body 21 and the fixed shaft member 23*a* included in the operation portion 10 are formed as separated bodies, but the present disclosure is not limited to this configuration. In the operation portion 10, the exterior body 21 and the fixed shaft member 23*a* may be integrally formed.

In the above-described embodiments, a configuration is described in which the sliding portion 100 is interposed between the sleeve 11 and the fixed shaft member 23*a*, but the present disclosure is not limited to this configuration. The sliding portion 100 may be interposed between the sleeve 11 and the exterior body 21.

In the above-described embodiments, a configuration is described in which the sliding portion 100 is fixed to the fixed shaft member 23*a* (i.e., the operation portion 10), but the present disclosure is not limited to this configuration. The sliding portion 100 may be fixed to the sleeve (i.e., one member) 11.

In the above-described embodiments, a configuration is described in which the sliding portion 100 is formed integrally with the fixed shaft member 23*a* as one member by insert molding or two-color molding, but the present disclosure is not limited to this configuration. The sliding portion 100 may be fixed to the one member by adhesive or the like.

In the above-described embodiments, a configuration is described in which the sliding portion 100 is provided inside the circumferential groove 24*c* in a position further depressed than the outer peripheral surface of the fitting tube 24, but the present disclosure is not limited to this configuration. The sliding portion 100 may protrude from, for example, the outer peripheral surface of the fitting tube 24.

In the above-described embodiments, a configuration is described in which the exterior body 21 is formed in a shape of a cylinder with a bottom, but the present disclosure is not limited to this configuration. It is sufficient that at least a grip portion of the exterior body 21 on which rotational operation by the user can be performed when operating the dispensing container 1 is exposed to the outside.

In the above-described embodiments, a configuration is described in which the sliding portion 100 is sandwiched between the operation portion 10 and the sleeve 11 in the radial direction, but the present disclosure is not limited to this configuration. A configuration may be adopted in which the sliding portion 100 is sandwiched between the operation portion 10 and the sleeve 11 in the up-down direction.

In the above-described embodiments, a configuration is described in which the dispensing member 23 includes the inner transmission shaft 26 and the outer transmission shaft 23*b*, but the present disclosure is not limited to this configuration. It is sufficient that the dispensing member 23 includes at least the inner transmission shaft 26.

In the above-described embodiments, a configuration is described in which the exterior body 21 and the inner member 22 as an operation cylindrical portion are provided, but the present disclosure is not limited to this configuration. The operation cylindrical portion may include only the exterior body 21.

In the above-described embodiments, a configuration is described in which the outer peripheral surface of the transmission shaft is provided with the spiral groove and the movable shaft surrounds the outside of the transmission shaft, but the present disclosure is not limited to this configuration. For example, a configuration may be adopted in which the inner peripheral surface of a transmission shaft having a cylindrical shape is provided with a spiral groove, and a movable shaft including an engagement protrusion is disposed inside the transmission shaft.

Within the scope of the present disclosure, the components of the above-described embodiments can be appropriately replaced with well-known components, and the above-described modifications may be appropriately combined together.

The invention claimed is:

1. A dispensing container, comprising:

an operation portion including a dispensing member, the dispensing member extending in an up-down direction and being provided with a spiral groove;

a sleeve surrounding an outside of the dispensing member and provided so as to be rotatable on an axis line of the dispensing member;

a middle plate body holding contents and provided inside the sleeve so as to be movable in the up-down direction in a state where rotation of the middle plate body on the axis line relative to the sleeve is restricted; and a movable shaft extending downward from the middle plate body and including an engagement protrusion that engages with the spiral groove, wherein a sliding portion, which is formed of a softer material than either one member of the sleeve and the operation portion and on which the other member of the sleeve and the operation portion slides as the sleeve and the operation portion rotate relative to each other, is fixed to the one member, the operation portion is provided with a circumferential groove, the circumferential groove opening outward in a radial direction and extending on an entire circumference around the axis line, the sleeve is provided with a protrusion, the protrusion protruding inward in the radial direction and being accommodated in the circumferential groove, the sliding portion is integrally fixed to an inner surface of the circumferential groove, and the protrusion moves inside the circumferential groove while sliding on the sliding portion as the sleeve rotates on the axis line.

2. The dispensing container according to claim 1, wherein the protrusion is provided to include protrusions at intervals around the axis line, and the sliding portion extends on an entire circumference around the axis line.

3. The dispensing container according to claim 2, wherein the operation portion includes an exterior body having a shape of a cylinder with a bottom, the dispensing member includes a fixed shaft member attached to a bottom wall of the exterior body, and the sliding portion is integrally fixed to the fixed shaft member.

4. The dispensing container according to claim 1, wherein the operation portion includes an exterior body having a shape of a cylinder with a bottom, the dispensing member includes a fixed shaft member attached to a bottom wall of the exterior body, and the sliding portion is integrally fixed to the fixed shaft member.

* * * * *